US007704169B1

(12) United States Patent
Bove et al.

(10) Patent No.: US 7,704,169 B1
(45) Date of Patent: Apr. 27, 2010

(54) UNIVERSAL BASEBALL PRACTICE SYSTEM

(75) Inventors: Mauro Bove, Oceanside, CA (US); Ken Cook, Oceanside, CA (US); Glenn Griffin, Glendale, AZ (US)

(73) Assignee: Solo Sports Group, Inc., Oceanside, CA (US)

( * ) Notice: Subject to any disclaimer, the term of this patent is extended or adjusted under 35 U.S.C. 154(b) by 0 days.

(21) Appl. No.: 12/348,192

(22) Filed: Jan. 2, 2009

(51) Int. Cl.
*A63B 69/00* (2006.01)

(52) U.S. Cl. ..... 473/426; 473/454

(58) Field of Classification Search ..... 273/395, 273/396, 398–402; 473/426, 428–430, 454–456, 473/476, 478, 434, 435
See application file for complete search history.

(56) References Cited

U.S. PATENT DOCUMENTS

| | | | | | |
|---|---|---|---|---|---|
| 4,210,326 | A | * | 7/1980 | Booth et al. | 473/454 |
| 4,650,189 | A | * | 3/1987 | Rajacich | 473/434 |
| 4,978,121 | A | * | 12/1990 | Larkey | 473/454 |
| 5,040,791 | A | | 8/1991 | Ratajac | |
| 5,333,856 | A | * | 8/1994 | Gery | 473/454 |
| 5,351,948 | A | * | 10/1994 | Thomas | 473/417 |
| 5,458,326 | A | | 10/1995 | Marcyes | |
| 5,516,115 | A | * | 5/1996 | McLain | 473/417 |
| 5,539,957 | A | | 7/1996 | Schmidt | |
| 5,588,646 | A | | 12/1996 | Dickson | |
| 5,678,824 | A | * | 10/1997 | Fortier et al. | 273/407 |
| 5,776,017 | A | | 7/1998 | Brawn | |
| 5,795,250 | A | | 8/1998 | Cripe | |
| 5,906,552 | A | * | 5/1999 | Padilla | 473/421 |
| 6,086,488 | A | | 7/2000 | Sanders | |
| 6,168,540 | B1 | | 1/2001 | McKenna | |
| D442,242 | S | * | 5/2001 | Rajacich | D21/705 |
| 6,880,828 | B2 | * | 4/2005 | Liao | 273/395 |
| 7,021,630 | B1 | * | 4/2006 | Cho | 273/401 |
| 7,252,603 | B2 | | 8/2007 | Bove | |
| 2005/0181894 | A1 | * | 8/2005 | Hickman | 473/435 |
| 2006/0223657 | A1 | * | 10/2006 | Flanigan | 473/423 |
| 2007/0090601 | A1 | * | 4/2007 | Liao | 273/396 |

* cited by examiner

*Primary Examiner*—Mark S Graham
(74) *Attorney, Agent, or Firm*—Frank G. Morkunas

(57) ABSTRACT

A baseball practice system for training one in pitching, throwing, fielding, catching, and batting. The practice system is portable and collapsible having a removable pitching component on one side and a batting and netting on the other side. The pitching component has a strike-zone opening and one or more pockets in a catch sack in back of the strike-zone opening. The netting is of an elastic material suited to rebound a ball thrown on the netting for the purpose of practicing throwing, catching, and fielding. A ball component, attached to elastic cords, is suspended outward and downward from a forward extending member adjacent to the top of the baseball practice system. An adjustment and locking member adjacent to the rear of the forward extending member adjustably secures in place an upper cord which is attached to a ball.

14 Claims, 2 Drawing Sheets

UNIVERSAL BASEBALL PRACTICE SYSTEM

CROSS REFERENCES TO RELATED APPLICATIONS

None.

STATEMENT REGARDING FEDERALLY-SPONSORED RESEARCH OR DEVELOPMENT

Not applicable.

BACKGROUND

This currently described device relates to an improvement in baseball-practice devices, and more particularly to collapsible and truly portable multi-purpose practice device suitable for batting practice, pitching practice, catching practice, throwing practice, and fielding practice for use by one person or two persons and which furthermore is easily collapsible, easily returned to an operational state, and easily transportable.

Baseball is an extremely popular sport from the backyard player to the sandlot to schools to professional sports. Many elements are associated with this popular game. Among one of the most important is batting as without good batting skills no runs can be scored. For defensive play, good pitching, catching, fielding, and throwing skills are also key elements to the overall game play.

Coaching and practice are key elements to attaining better batting skills, pitching skills, catching skills, fielding skills, and throwing skills in play. For batting, a common method of improving a player's swing is to bat against live pitchers or against a pitching machine. This of course requires more than one ball player, in the case of live pitching, or many players merely standing around waiting for their turn to bat in the case of pitching machines. Time and manpower are wasted and pitching machines are costly in purchase and in maintenance. Additionally, most players also like to take practice swings against a baseball during a game while waiting for their turn to bat.

Several batting type devices have been designed for the purpose of permitting a single player to practice swinging at a ball with a bat typically where a single rope or cord was merely tethered to a ball. After striking the ball using this device, the ball would continue to circle around and around until it loses its speed or the cord becomes wrapped around its support structure. In such instances, the player has to reset the ball by unwinding it or waiting for the ball to stop circling. Time is wasted in the process.

A patent to Ratajac (U.S. Pat. No. 5,040,791) teaches a collapsible portable batting cage having an upper frame assembly, a lower frame assembly, a rear frame assembly on top and bottom, and one side frame assembly on each side of the upper and lower frame assemblies. A length of shock cord (elastic bungee type cord) is threaded through a vertical bore hole in a ball. The shock cord attaches to the top front, back to the top rear, and is insertably adjustable into one of a plurality of holes, of pre-determined spacing, on one side of the top rear assembly. The other end of the shock cord attaches to the bottom front and back to the rear frame on the bottom.

The ball is suspended approximately mid-height a the front by a non-elastic line (referred to as a safety line) attached to the ball with its two ends attached at approximately mid-height at the rear on the side frames. The height of the static position of the ball is adjustable by moving the shock cord at the rear frame assembly to different locations. This device is portable due to the nature of its light weight components and it is also collapsible which allows it to be stored or carried in a compact manner. Collapsing this device, however, requires that all fasteners must be removed from the frame components and that the frame components be removed from each other and, when its use is required, that they all be re-assembled. An extremely time-consuming process. In addition, the safety line has a tendency to interfere with a swing which is angled slightly up or down from a perfect horizontal swing.

A patent to McKenna (U.S. Pat. No. 6,186,540) describes a portable apparatus for the practice of a person's batting swings that includes a frame, a net, and a ball attached to non-elastic cords. Each lower terminal end of the frame has a ball-engaging eye bolt. A pair of net-engaging uprights of the frame have a pair of tubes that are formed as one-piece therewith for ease of manufacture by eliminating a need for welding. Button fasteners replaceably maintain the members of the frame together for ease of fabrication and collapsing by eliminating a need for nuts and bolts. A second upper member of the frame has a plurality of ball-engaging blind bores for adjusting the height of the ball.

A lowermost terminal edge of the net drapes so as to prevent any balls from rolling thereunder while providing a dampening effect for the ball when hit against the net. There is no lower cross member which eliminates any rebound of a ball that hits low on the net. One section of the non-elastic cords extend from the ball first upward to the top front then to the side attaching any one of the pre-determined blind bores. Two sections of the non-elastic cords emanate from the bottom of the ball and attach to either bottom rear side of the frame. This device eliminates the problems associated with the safety lines of Ratajac; but, the non-elasticity of the cords limits its effect of travel and renders it slower to rebound and reset.

As with the Ratajac device, this device, though it may be "collapsible" it too must be taken apart for travel and re-assembled when need. Also a time-consuming process. Typically, after each device is first assembled, users generally leave them assembled and either leave them where there are or find a means to transport them, in their assembled state, to the desired location. Either prospect renders each such device less desirable. Moreover, if left assembled, each takes up quite a bit of storage space.

A patent issued to the current inventors solved and overcame the problems noted in the prior-art devices; U.S. Pat. No. 7,252,603, which issued on Aug. 7, 2007. Our patented device solved all the problems associated with the above referenced prior-art devices. Because the frame components are hingedly connected, the entire device of our patent was truly collapsible. From its assembled state, the device easily and quickly "folds" into a "dis-assembled" state for storage or transportation and easily and quickly "unfolds" into an assembled stated when it is needed. Height adjustment for the ball is not based on a pre-determined set of height increments but can be adjusted to accommodate even the slightest of increments to the millimeter.

Safety/return lines are structured as not to interfere with a batter's swing and a removably attachable rear elastic cord removably attachable to the ball facilitates resetting of the ball after it has been struck and is a greater practice aid for an experience player. Its removability permits a less experienced player, who may have a tendency to under swing the ball and hit the cord below the ball, to also use the same device by merely removing this cord from the bottom of the ball. Detailed adjustments to all the cord components permits a skilled user to make minute adjustments to tautness to thereby establish a sense of dynamic reality in the batting/swinging practice.

Our patented device has been greatly improved upon by the currently described device/system contained in the application. It is considered a system in that it is a multi-function device which permits a single user, with no outside assistance, to practice the five major elements of the game; batting, catching, fielding, throwing, and pitching. The new multi-function device is more easily collapsible, more easily restorable to a useful mode, more easily transportable, and more easily storable.

The batting element, though similar to our patented device is more easily adjustable for different sized user. A web-like elastic concave netting in back of the ball allows a user to throw the ball into the netting from and distance to hone throwing skills. Depending on from where thrown and to where on the netting, the ball will be cast back to the thrower either as a fly ball, a line drive, or a grounder thereby honing skills for fielding ground balls and catching line drives or fly balls.

The pitching element is on the opposite side of the catching element. It has a cut-out area with is the size of an average strike zone with a pocket therein to retain any balls thrown into the strike zone. As a complete universal baseball practice system, our new inventive concept cannot be beat. It allows for a single user to practice all the key elements to the game or it allows for two people to use it at the same time; one person practicing on the pitching side and the other person practicing either batting, catching, fielding, or throwing on the opposite side [the batting/catching side].

The foregoing has outlined some of the more pertinent objects of the universal baseball practice system of this disclosure. These objects should be construed to be merely illustrative of some of the more prominent features and applications of the universal baseball practice system of this disclosure. Many other beneficial results can be attained by applying the disclosed universal baseball practice system of this disclosure in a different manner or by modifying the universal baseball practice system of this disclosure within the scope of the disclosure. Accordingly, other objects and a fuller understanding of the universal baseball practice system of this disclosure may be had by referring to the summary of the universal baseball practice system of this disclosure and the detailed description of the preferred embodiment in addition to the scope of the universal baseball practice system of this disclosure defined by the claims taken in conjunction with the accompanying drawings.

SUMMARY

The above-noted problems, among others, are overcome by the universal baseball practice system of this disclosure. Briefly stated, the universal baseball practice system of this disclosure contemplates a complete practice system for training use in training one in baseball's essential elements of pitching, throwing, fielding, catching, and batting. The practice system is portable and collapsible having a removable pitching component removably attached on one side and a batting and netting removably attached on the other side.

The pitching component has a strike-zone opening into which a user practices pitching a ball into the strike zone. A catch sack is in back of the strike-zone opening to retain the balls thrown therein for ease of retrieval. The catch sack has one or more dividers, either vertically disposed, horizontally disposed, or both, thereby defining pockets for practicing greater precision of pitching.

The netting is of an elastic material suited to rebound a ball thrown on the netting for the purpose of practicing throwing, catching, and fielding. It is removably attachable to the practice system. As attached, the netting is somewhat curvilinear [concave] in order to replicate various forms of rebound [i.e., line drives, fly balls, ground balls] in any direction and at any angle.

A removable ball component, attached to elastic cords [an upper cord and two lower cords], is suspended outward and downward from a forward extending member adjacent to the top of the baseball practice system. An adjustment and locking member adjacent to the rear of the forward extending member adjustably secures in place an upper cord which is attached to the top of a ball. The two lower cords attach to the bottom of the ball at one end and to the bottom of the practice system on opposite sides.

The foregoing has outlined the more pertinent and important features of the universal baseball practice system of this disclosure in order that the detailed description that follows may be better understood so the present contributions to the art may be more fully appreciated. Additional features of the universal baseball practice system of this disclosure will be described hereinafter which form the subject of the claims. It should be appreciated by those skilled in the art that the conception and the disclosed specific embodiment may be readily utilized as a basis for modifying or designing other structures and methods for carrying out the same purposes of the universal baseball practice system of this disclosure. It also should be realized by those skilled in the art that such equivalent constructions and methods do not depart from the spirit and scope of the universal baseball practice system of this disclosure as set forth in the appended claims.

BRIEF DESCRIPTION OF THE DRAWINGS

For a fuller understanding of the nature and objects of the universal baseball practice system of this disclosure, reference should be had to the following detailed description taken in conjunction with the accompanying drawings in which.

DETAILED DESCRIPTION

Figure 1:
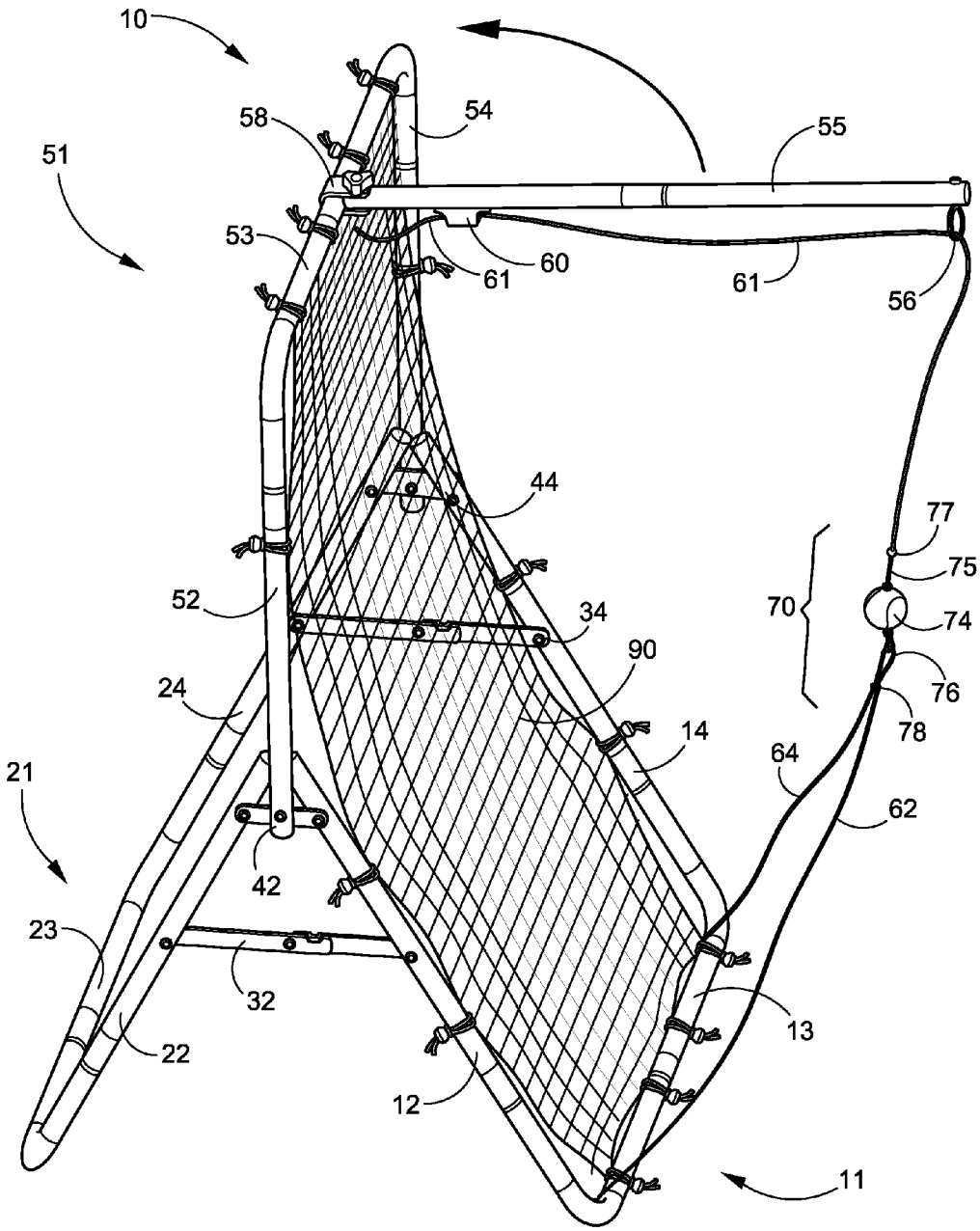
FIG. 1 is a perspective view of the baseball practice system detailing the frame, netting, forward extending member, and ball component.

Referring now to the drawings in detail and in particular to FIG. 1, reference character 10 generally designates the universal baseball practice system constructed in accordance with a preferred embodiment thereof illustrating the three key elements thereon, the batting element 70, 61, 62, 63, 55, 56, 57, the catching element 90, both on the batting/catching side [for the practice of throwing, catching, and fielding], and the pitching element 80 on the opposite side.

The frame construction of this universal baseball practice system is key to its universality, collapsibility, and transportability. It has a first U-shaped tubular foot 11 [also referred to as the front U-shaped tubular foot] and a second U-shaped tubular foot 21 [also referred to as the back or rear U-shaped tubular foot]. The first U-shaped tubular foot 11 has a left-side leg 12, a bottom leg 13, and a right-side leg 14. Similarly, the second U-shaped tubular foot 21 has a left-side leg 22, a bottom leg 23, and a right-side leg 24.

Each U-shaped tubular foot 11, 21 [front and back (or rear)] are hingedly connected to each other by a right-side hinge 44 at their respective right-side legs 14, 24 and by a left-side hinge 42 at their respective left-side legs, 12, 22. An upper U-shaped tubular member 51 having a left-side section 52, a top section 53, and a right-side section 54 is lockably and hingledly connected to the right-side hinge 44 at its right-side 54 and to the left-side hinge 42 at its left-side 52.

A lockable folding bracket 32 is connected to the respective left-side 12, 22 and near to the top of each U-shaped tubular foot 11, 12 while a second lockable folding bracket 34 is connected to the respective right-sides 14, 24 and also near to the top of each U-shaped tubular foot 11, 12. These U-shaped tubular feet 11, 12, and upper U-shaped tubular member 51, are illustrated in FIG. 1 in their assembled, operational mode. The first and second lockable folding brackets 32, 34 are extended and locked in place thereby separating the bottom legs 13, 23 apart from each other forming a strong triangular footing for the universal baseball practice system.

The upper U-shaped tubular member 51 is locked into place approximately perpendicular to the ground. A forward extending member 55 is hingedly and lockably connected to the top section 53 of the upper U-shaped tubular member 51 at the swivel hinge 58. The swivel hinge 58 is approximately at the center of the top section 53. The ball component 70 comprises the ball 74, a upper cord 75 attached to the ball 74 at one end and an upper ball connector 77 at the other end, a lower cord 76 attached to the ball 74 at one end and an lower ball connector 78 at the other end. An upper main cord 61 is removably attached to the upper ball connector 77 at one end, and runs through the first guide pulley or ring 56 at approximately at the front end of forward extending member 55 and back to and through a second guide pulley or ring 57 at the top section 53 of the upper U-shaped member 51. These guides 56, 57 may be pulleys or may be hanging rings or any combination of either.

Figure 3:
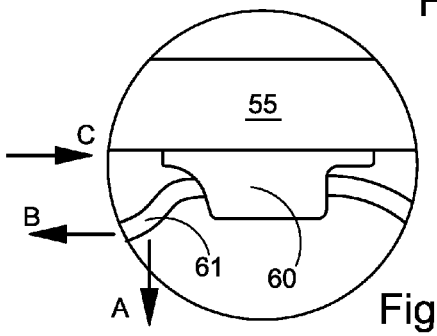
FIGS. 3 and 4 are detailed views of the adjustment and locking member of the baseball practice system.
Figure 4:
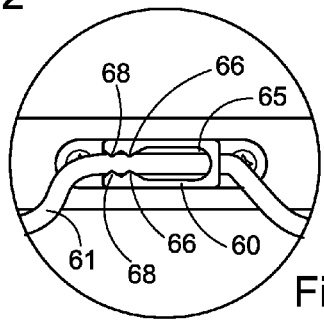

Seen in detail in FIGS. 3 and 4 is an adjustment and locking member 60 [a bungee cleat locking device] through which the upper cord 61 is placed, adjusted, and held in place. The locking member 60 is adjacent to the rear of, and on the bottom if, the forward extending member 55. The upper cord 61 is inserted into the chamber 65 in the locking member 60, which as shown and configured is exposed, and past and into the first set of gripping teeth 66 and the second set of gripping teeth 68 which are on opposing sides of the chamber 65 in the locking member 60. As so placed, the two sets of gripping teeth 66, 68 hold the upper cord, and concomitantly, the ball component 70 in place.

As the upper cord 61 is pulled down in the direction of Arrow A, it is released from the hold of the two sets of gripping teeth 66, 68 and may be and then may be pulled in either the direction of Arrow B or Arrow C thereby adjusting the upper line 61 up or down as desired by the user. The ball component 70 will adjust upward and downward accordingly. Once at the desired level, the user re-inserts the upper cord 61 into the two sets of gripping teeth 66, 68.

Attached to the lower ball connector 78 are a left-side lower cord 62 and a right-side lower cord 64. The far ends of each of these lower cords 62, 64 are removably connected at the bottom leg 13 on its respective left and right sides or onto the respective left-side leg 12 and right-side leg 14.

It is preferred that the upper cord 61 be made of an elastic or bungee-like material as well at the lower cords 62, 64, though such is not as critical for the lower cords 62, 64 as it is for the upper cord 61. The upper and lower lines 75, 76 should generally be of a non-elastic material, though they may also be elastic.

Figure 2:
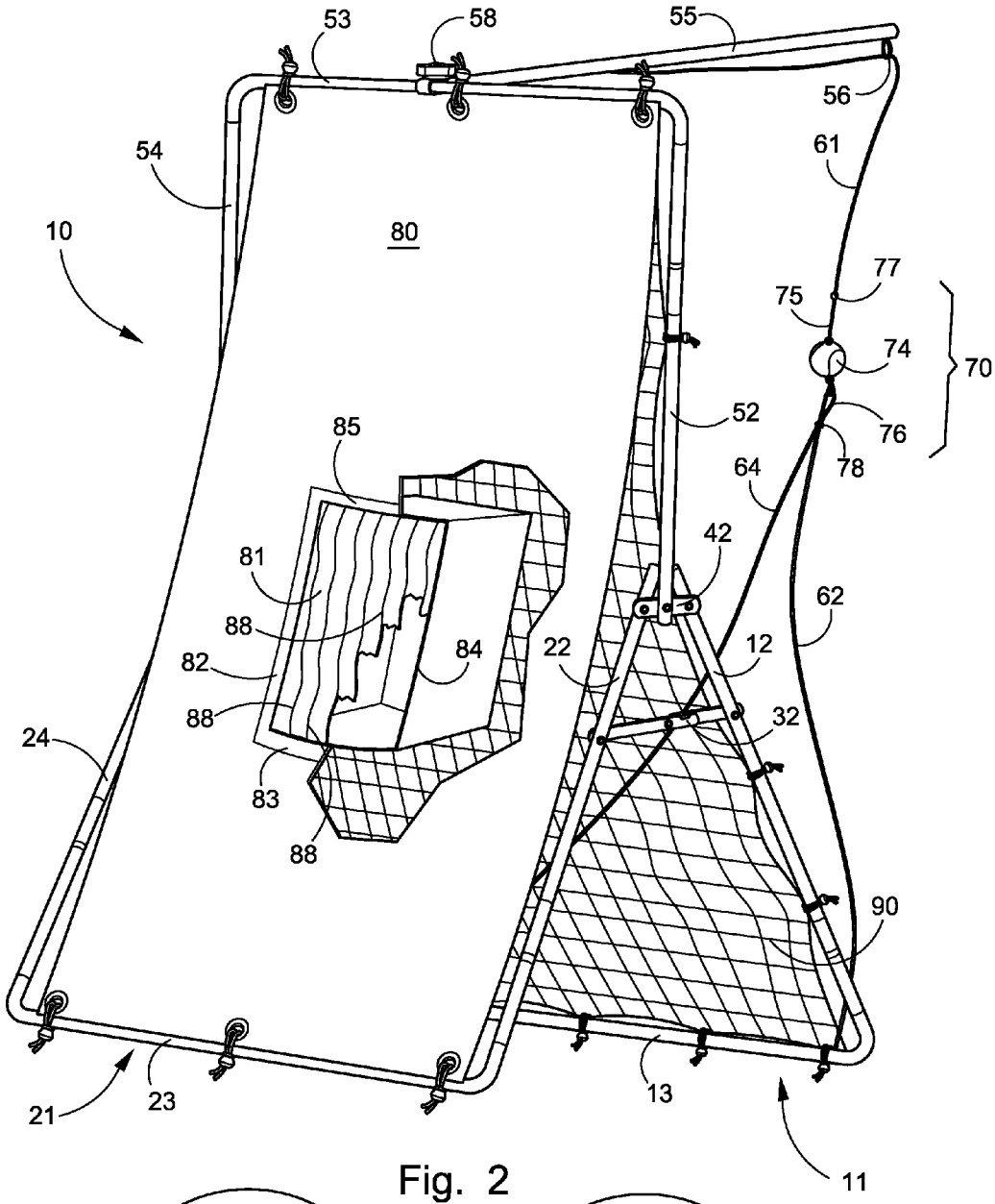
FIG. 2 is a perspective view of the baseball practice system detailing the pitching component with strike-zone and catch sack.

The catching element 90, which also comprises the throwing and fielding elements may be on the batting side [also referred to for administrative convenience as the front side] or may be on the back side where the pitching element 80 is currently illustrated to be in FIGS. 1 and 2. The catching element 90 should generally be made of an elastic material and should generally be of a "netting" construction as illustrated in FIG. 1. It is removably attachable to the top section 53 of the upper U-shaped tubular member 51 and to the first U-shaped tubular foot 11 [also referred to as the front U-shaped tubular foot].

The pitching element 80 has an opening therein 81 which has the approximate dimensions of a typical strike-zone having a left-side strike zone 82, a top-side strike zone 85, a right-side strike zone 84, and a bottom-side strike zone 83. The typical width of a strike zone is the width of home plate, approximately 17 inches.

The strike zone is currently defined as that area over home plate the upper limit of which is a horizontal line at the midpoint between the top of the shoulders and the top of the uniform pants, and the lower level is a line at the bottom of the knees. The strike zone is determined from the batter's stance as the batter is prepared to swing at a pitched ball. Consequently a strike zone will vary with the varying height of players. The average for our strike zone is based on the average height of typical ball players with the bottom 83 being approximately 23 inches from the ground and the top 85 being approximately 36 inches from the ground.

So not to lose balls being thrown into the strike zone, there is a catch-sack or similar retaining means to stop and hold the ball once it passes through the opening 81 and hold it there until the user wishes to retrieve the one or more balls held therein. Multiple divider strips 88 retain balls thrown therein in the respective "pocket" as defined by two adjacent divider strips 88. As shown, the divider strips 88 are relatively vertically disposed but also may be horizontally disposed or both thereby defining smaller distinct pockets. The inclusion of the divider strips 88 will assist the user in training for greater accuracy.

To give the pitching component 80 a somewhat concave configuration the lower ends of the catching element 90 are attached to the bottom leg 13 and to the left-side leg 12 and right-side leg 14 upwards thereon approximately two-thirds to three-quarters up the respective legs 12, 14. The upper ends of the catching element 90 are attached to the top section 53 and to the left-side 52 and right-side 54 downwards thereon approximately two-thirds to three-quarters down the respective sides 52, 54.

The pitching element 80 is removably attached to the back side. The upper end of the pitching element 80 is attached to the top section 53 and the lower end of the pitching element 80 is attached to the bottom leg 23 of the second U-shaped tubular foot 21 [also referred to as the back [or rear] U-shaped tubular foot].

The present disclosure includes that contained in the present claims as well as that of the foregoing description.

Although this universal baseball practice system of this disclosure has been described in its preferred forms with a certain degree of particularity, it is understood that the present disclosure of the preferred forms has been made only by way of example and numerous changes in the details of construction and combination and arrangement of parts and method steps may be resorted to without departing from the spirit and scope of the universal baseball practice system of this disclosure. Accordingly, the scope of the universal baseball practice system of this disclosure should be determined not by the embodiment[s] illustrated, but by the appended claims and their legal equivalents.

Applicant[s] have attempted to disclose all the embodiment[s] of the universal baseball practice system of this disclosure that could be reasonably foreseen. It must be understood, however, that there may be unforeseeable insubstantial modifications to universal baseball practice system of this disclosure that remain as equivalents and thereby falling within the scope of the universal baseball practice system of this disclosure.

What is claimed is:

1. A universal baseball practice system comprising:

(a) a first U-shaped foot having a left side leg with a top and a bottom, a right side leg with a top and a bottom, and a bottom leg attached to the respective bottom of said left side leg and said right side leg;

(b) a second U-shaped foot having a left side leg with a top and a bottom, a right side leg with a top and a bottom, and a bottom leg attached to the respective bottom of said left side leg and said right side leg;

(c) an upper U-shaped member having a left side section with a top and a bottom, a right side section with a top and a bottom, and a top section attached to the respective top of said left side section and said right side section;

(d) a left side connecting member to which the top of the left side leg of the first U-shaped foot, the top of the left side leg of the second U-shaped foot, and the bottom of left side section of the upper U-shaped member are each pivotably attached;

(e) a right side connecting member to which the top of the right side leg of the first U-shaped foot, the top of the right side leg of the second U-shaped foot, and the bottom of right side section of the upper U-shaped member are each pivotably attached;

(f) a netting to which a ball may be thrown and rebounded, said netting having a net top, a net bottom, a net right side, and a net left side, wherein said net top is removably attached to a first side of the top section of said upper U-shaped member, said net bottom is removably attached to the bottom leg of said first U-shaped foot, said net right side is removably attached to the right side section of the upper U-shaped member and to the right side leg of the first U-shaped foot, and said net left side is removably attached to the left side section of the upper U-shaped member and to the left side leg of the first U-shaped foot;

(g) a pitching component having a pitch-top, a pitch-bottom, and a pitch-strike zone opening therein wherein said pitch-strike zone opening has a top zone, a left side zone, a right side zone, a bottom zone, and a catch sack in back of said strike zone opening, wherein said pitch-top is removably attached to a second side of the top section of said upper U-shaped member and said pitch-bottom is removably attached to the bottom leg of said second U-shaped foot;

(h) a forward extending member having a first end and a second end wherein said first end is pivotably attached to the top section of said upper U-shaped member and a front guide member is attached to said second end; and (i) a ball component, said ball component comprising a ball having a ball top and a ball bottom, an upper cord component having a top end and a bottom end wherein said bottom end is attached to said ball and said top end passes through said front guide member and extends rearward to said first end of said forward extending member, a left side lower cord component having a top and a bottom wherein said bottom is removably attachable to a left side of said bottom leg of said first U-shaped foot and said top is attachable to said ball, and a right side lower cord component having a top and a bottom wherein said bottom is removably attachable to a right side of said bottom leg of said first U-shaped foot and said top is attachable to said ball, and wherein said upper cord component, said left side lower cord component, and said right side lower cord component are comprised of an elastic material.

2. The universal baseball practice system as defined in claim 1 further comprising means for securing said universal baseball practice system in an upright and operational position.

3. The universal baseball practice system as defined in claim 2 wherein said means for securing said universal baseball practice system in an upright and operational position comprises a left-side bracket foldably and lockably attached to the left side leg of said second U-shaped foot and to the left side leg of said first U-shaped foot and a right-side bracket foldably and lockably attached to the right side leg of said second U-shaped foot and to the right side leg of said first U-shaped foot.

4. The universal baseball practice system as defined in claim 1 further comprising an adjustment and locking member on said forward extending member through which said upper cord component inserts through and locks in place.

5. The universal baseball practice system as defined in claim 4 wherein said adjustment and locking member comprises a channel therethrough to receive said upper cord component and a set of gripping teeth on opposing sides of said channel to lock said upper cord component in place thereat.

6. The universal baseball practice system as defined claim 1 wherein said netting is comprised of elastic material.

7. The universal baseball practice system as defined in claim 1 further comprising a plurality of strip dividers horizontally disposed in said catch sack of said pitching component, vertically disposed in said catch sack of said pitching component, or both.

8. A universal baseball practice system comprising:

(a) a first U-shaped foot having a left side leg with a top and a bottom, a right side leg with a top and a bottom, and a bottom leg attached to the respective bottom of said left side leg and said right side leg;

(b) a second U-shaped foot having a left side leg with a top and a bottom, a right side leg with a top and a bottom, and a bottom leg attached to the respective bottom of said left side leg and said right side leg;

(c) an upper U-shaped member having a left side section with a top and a bottom, a right side section with a top and a bottom, and a top section attached to the respective top of said left side section and said right side section;

(d) a left side connecting member to which the top of the left side leg of the first U-shaped foot, the top of the left side leg of the second U-shaped foot, and the bottom of left side section of the upper U-shaped member are each pivotably attached;

(e) a right side connecting member to which the top of the right side leg of the first U-shaped foot, the top of the right side leg of the second U-shaped foot, and the bottom of right side section of the upper U-shaped member are each pivotably attached;

(f) a netting to which a ball may be thrown and rebounded, said netting having a net top, a net bottom, a net right side, and a net left side, wherein said net top is removably attached to a first side of the top section of said upper U-shaped member, said net bottom is removably attached to the bottom leg of said first U-shaped foot, said net right side is removably attached to the right side section of the upper U-shaped member and to the right side leg of the first U-shaped foot, and said net left side is removably attached to the left side section of the upper U-shaped member and to the left side leg of the first U-shaped foot;

(g) a pitching component having a pitch-top, a pitch-bottom, and a pitch-strike zone opening therein wherein said pitch-strike zone opening has a top zone, a left side zone, a right side zone, a bottom zone, and a catch sack in back of said strike zone opening, wherein said pitch-top is removably attached to a second side of the top section of said upper U-shaped member and said pitch-bottom is removably attached to the bottom leg of said second U-shaped foot;

(h) a forward extending member having a first end and a second end wherein said first end is pivotably attached to the top section of said upper U-shaped member and a front guide member is attached to said second end;

(i) a ball component, said ball component comprising a ball having a ball top and a ball bottom, an upper cord component having a top end and a bottom end wherein said bottom end is attached to said ball and said top end passes through said front guide member and extends rearward to said first end of said forward extending member, a left side lower cord component having a top and a bottom wherein said bottom is removably attachable to a left side of said bottom leg of said first U-shaped foot and said top is attachable to said ball, and a right side lower cord component having a top and a bottom wherein said bottom is removably attachable to a right side of said bottom leg of said first U-shaped foot and said top is attachable to said ball; and (j) an adjustment and locking member on said forward extending member through which said upper cord component inserts through and locks in place.

9. The universal baseball practice system as defined in claim 8 further comprising means for securing said universal baseball practice system in an upright and operational position.

10. The universal baseball practice system as defined in claim 9 wherein said means for securing said universal baseball practice system in an upright and operational position comprises a left-side bracket foldably and lockably attached to the left side leg of said second U-shaped foot and to the left side leg of said first U-shaped foot and a right-side bracket foldably and lockably attached to the right side leg of said second U-shaped foot and to the right side leg of said first U-shaped foot.

11. The universal baseball practice system as defined in claim 8 wherein said upper cord component, said left side lower cord component, and said right side lower cord component are comprised of an elastic material.

12. The universal baseball practice system as defined in claim 8 wherein said adjustment and locking member comprises a channel therethrough to receive said upper cord component and a set of gripping teeth on opposing sides of said channel to lock said upper cord component in place thereat.

13. The universal baseball practice system as defined in claim 8 wherein said netting is comprised of elastic material.

14. The universal baseball practice system as defined in claim 8 further comprising a plurality of strip dividers horizontally disposed in said catch sack of said pitching component, vertically disposed in said catch sack of said pitching component, or both.

* * * * *